US008388387B2

(12) United States Patent
Koellmann

(10) Patent No.: US 8,388,387 B2
(45) Date of Patent: Mar. 5, 2013

(54) CONNECTING TERMINAL WHERE OPERATING ELEMENT EXERTS A TENSILE FORCE

(75) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 13/161,924

(22) Filed: Jun. 16, 2011

(65) Prior Publication Data

US 2011/0318972 A1 Dec. 29, 2011

(30) Foreign Application Priority Data

Jun. 23, 2010 (DE) ..... 10 2010 024 809

(51) Int. Cl.
*H01R 4/48* (2006.01)

(52) U.S. Cl. ..... 439/729

(58) Field of Classification Search ..... 439/729, 439/834–836

See application file for complete search history.

(56) References Cited

U.S. PATENT DOCUMENTS

| | | | | |
|---|---|---|---|---|
| 5,679,021 | A * | 10/1997 | Kramer | 439/835 |
| 6,290,516 | B1 * | 9/2001 | Gerber | 439/110 |
| 6,786,779 | B2 * | 9/2004 | Feldmeier et al. | 439/729 |
| 7,083,463 | B2 * | 8/2006 | Steinkemper et al. | 439/441 |
| 7,384,319 | B2 * | 6/2008 | Kirstein et al. | 439/839 |
| 7,510,448 | B2 * | 3/2009 | Eppe et al. | 439/835 |
| 7,607,956 | B2 * | 10/2009 | Lang et al. | 439/835 |
| 7,651,363 | B2 * | 1/2010 | Koellmann | 439/441 |
| 7,674,140 | B2 * | 3/2010 | Eppe et al. | 439/816 |
| 2008/0280508 | A1 * | 11/2008 | Koellmann | 439/834 |

FOREIGN PATENT DOCUMENTS

| | | |
|---|---|---|
| DE | 3822980 | 7/1988 |
| DE | 202 08 724 | 4/2002 |
| DE | 10 2007 050 936 | 7/2009 |
| EP | 1 622 224 | 1/2006 |

* cited by examiner

*Primary Examiner* — Amy Cohen Johnson
*Assistant Examiner* — Vladimir Imas
(74) *Attorney, Agent, or Firm* — Whitham Curtis Christofferson & Cook, PC

(57) ABSTRACT

A connecting terminal (1) having an insulating-material housing (2) and having at least one spring clamping unit with a clamping spring (4) and a busbar section (3), in the insulating-material housing (2), is described. The clamping spring (4) has a contact section (6) and a clamping section (8) which is designed to clamp an electrical conductor against the busbar section (3). The clamping spring (4) has an operating section (13) which originates from the clamping section (8), extends away from the direction of the spring force, which acts on the clamping section (8), of the clamping spring (4) and is aligned to be acted on by an attachment element (16, 31, 33, 39) such that the operating element (16, 31, 33, 39) can be engaged with the operating section (13) in order to exert a tensile force, which acts on the operating section (13) in the opposite direction to the spring force when the operating element (16, 31, 33, 39) is moved, in order to open the clamping spring (4).

10 Claims, 7 Drawing Sheets

CONNECTING TERMINAL WHERE OPERATING ELEMENT EXERTS A TENSILE FORCE

FIELD OF THE INVENTION

The invention relates to a connecting terminal having an insulating-material housing and having at least one spring clamping unit with a clamping spring and a busbar section in the insulating-material housing, with the clamping spring having a contact section and a clamping section which is designed to clamp an electrical conductor against the busbar section.

BACKGROUND

Spring-force connecting terminals such as these are known in many forms. An electrical conductor is pushed against a busbar section by a clamping section, by the spring force of a clamping spring, and in this way makes an electrically conductive contact between the busbar section and the clamped-on electrical conductor.

In particular in order to remove an electrical conductor, the clamping spring must be moved against its spring force, and the clamping point must be opened. This is done using operating tools, such as screwdrivers, which are inserted into suitable operating openings, or their operating members which are fitted in the insulating-material housing of the connecting terminal.

By way of example, DE 202 08 724 U1 discloses a connecting terminal having an essentially C-shaped clamping spring, which is operatively connected to an operating lever and is fixed onto a busbar in the form of a cage. When the lever is operated, the conductor insertion opening is opened against the spring force of the clamping spring, thus allowing a conductor to be inserted. When the operating lever is returned, the electrical conductor is clamped against the busbar, in order to make an electrically conductive connection.

EP 1 622 224 B1 discloses a connecting terminal in which the clamping edge of the clamping limb of a clamping spring forms a clamping point with a busbar which is opposite the clamping edge. The clamping limb can be lifted off the busbar against the spring force by an operating lever which is held such that it can pivot in the insulating-material housing, in order to open a conductor insertion opening, or to release a clamped conductor. In the process, the lever presses on the clamping limb, with tensile forces acting in the housing sides, walls and housing intermediate walls.

DE 38 22 980 A1 discloses a connecting terminal in which a spring in the form of a fork is sprung apart and opened when an operating lever is opened, thus allowing an electrical conductor to be inserted. In order to close the clamping clip, the operating lever presses against a limb of the spring, which is in the form of a fork, in the opposite direction to the spring force, and clamps the electrical conductor, in this way to make an electrical contact. In this case, the clamping force is applied by the operating lever.

DE 10 2007 050 936 A1 discloses a connecting terminal having a cage tension spring, which has an opening in the clamping limb. A busbar which rests on the holding limb projects through the clamping limb. On the side of the holding limb facing away from the busbar, a curved spring area of the cage tension spring is operatively connected to an operating lever. The clamping point between the clamping limb and the busbar can be opened with the aid of the operating lever, which produces a compression force on the spring.

SUMMARY

Against this background, one object of the present invention is to provide an improved connecting terminal, in which the operation and the integration of an operating member and an insulating-material housing are improved.

The object is achieved by the connecting terminal of the type mentioned initially in that the clamping spring has an operating section which originates from the clamping section, extends away from the direction of the spring force, which acts on the clamping section, of the clamping spring and is aligned to be acted on by an operating element such that the operating element can be engaged with the operating section in order to exert a tensile force, which acts on the operating section in the opposite direction to the spring force when the operating element is moved, in order to open the clamping spring.

A lug which is formed integrally with the clamping spring is provided by the operating section which projects away from the clamping section, on which lug an operating element can act, in order to move the clamping section, by tensile force on this lug, against the spring force of the clamping spring, and to open the clamping point.

In contrast to the conventional solutions, in which operating elements open the clamping point by pressure on the clamping spring, the present invention allows different kinematics for operating elements to be integrated in the connecting terminal. These kinematics, which exert a tensile force on the lug, that is to say the operating section, have advantages, depending on the specific embodiment, in terms of the integration capability in the available physical space, the physical size, the force/moment conversion, the bearing in the insulating-material housing, etc.

An operating tool, such as a screwdriver, which can be inserted in an operating opening in the insulating-material housing can be used as an operating element. This operating tool can engage under the operating section which originates from the clamping section, in order to open the clamping spring by means of tensile force on the operating section.

However, it is particularly advantageous for the operating element to itself form part of the connecting terminal and to be mounted such that it can move on or in the insulating-material housing. By way of example, the operating element can thus be an operating lever which is mounted such that it can pivot in or on the insulating-material housing, an operating slide which is mounted such that it can move linearly on the insulating-material housing, or an operating wheel which is mounted such that it can rotate in the insulating-material housing.

The operating section of the clamping spring preferably has a bent end which is hooked into the operating element. This ensures that the operating element engages with the operating section of the clamping spring, and that the operating section follows the movement of the operating element when the operating element is moved by pulling on the operating section.

The clamping section of the clamping spring may have at least one free end, which is provided for clamping an electrical conductor onto the busbar section, said free end having a clamping edge. The operating section, which is formed integrally with the clamping section, of the clamping spring is bent away from the clamping section before the free end, such that a part of the width of the clamping section forms the at least one free end, and the other part or the other parts of the width of the clamping section forms or form the operating section. This allows the operating section to be formed integrally from the same sheet-metal spring material as the clamping spring. In this case, the operating section is cut or stamped out of the clamping section. Leaving the free ends of the clamping section which run away from the clamping section, the operating section is formed from the adjacent material of the clamping spring adjacent to the free end of the clamping section. In this case, the operating section is bent away from the free end of the clamping spring, facing in a different direction than the direction in which the free end of the clamping section extends.

In one embodiment of the connecting terminal, the contact section is bent facing in the direction of the clamping section. In this case, the clamping spring forms an aperture through which the clamping section or the operating section is passed. This results in a cage tension spring being formed, in which the longitudinal extent direction of the aperture is transverse with respect to a busbar section which is passed through the aperture.

A cage tension spring such as this now cannot be opened in the normal way by exerting a compression force on the clamping section, but can be opened by exerting a tensile force on the operating section of the clamping spring. This has the advantage that the operating element can be arranged opposite the clamping section in a completely different area of the insulating-material housing than that which has been normal until now.

The contact section, the clamping section and/or the operating section are/is in this case passed through the aperture such that the contact section, the clamping section and/or the operating section project/projects through the aperture, extending with one part in front of the aperture and with its other part behind the aperture.

It is particularly advantageous for a bracket to be arranged on the busbar section, and for the contact section to rest on the bracket. Opposite the contact section, the bracket engages under the busbar section such that the connecting terminal is self-supporting, and a holding force which is exerted by the contact section on the bracket can be compensated for via the bracket and a clamping force which is in the opposite direction and acts from the clamping section on the busbar section. In order to produce a completely self-supporting system, it is furthermore advantageous for the operating element to be mounted directly or indirectly on the busbar section or the bracket, in order to produce a relative movement between the operating section and the busbar section. This prevents the operating element from being supported essentially on the insulating-material housing. The tensile force which is applied to the operating section of the clamping spring is therefore, in this self-supporting system, absorbed by the busbar section, by the suspension relative to the busbar section, and the contact section, which rests thereon, of the clamping spring.

As an alternative to a bracket for bearing the contact section, the busbar section can be bent in the direction of the contact section in an area which is adjacent to the clamping section of the clamping spring, and can have an aperture for a part of the contact section and a part of the clamping section to pass through. In this case, the contact section rests on the busbar, on a boundary edge of the aperture.

The busbar section can also be used to form a holding pocket for the electrical conductor. For this purpose, it is advantageous for the busbar section to be angled in a U-shape opposite a conductor insertion opening for an electrical conductor in the insulating-material housing. The two mutually opposite parts of the U-shaped angled busbar section provide a holding area for an electrical conductor, the depth of which holding area is bounded by the connecting wall, which is transverse thereto, of the busbar section.

One problem which can occur when the clamping spring is operated by tensile force is that the force of the clamping spring forces the operating element back from the open position to the closed position of the clamping spring. It is therefore advantageous for a blocking lever to be articulated such that it can pivot on the upper face of the insulating-material housing. In this case, the blocking lever has a blocking section, which interacts with the operating lever, in order to hold the operating lever in the open position.

In this case, for example, the free end of the blocking lever can project through an aperture in the operating lever. When the operating lever is pivoted, the blocking lever is then moved out of its rest position over the contour of the operating lever in its aperture. As soon as the operating lever has been pivoted sufficiently far against the spring force, a blocking contour in the form of a step on the blocking lever can be placed against the operating lever. In this case, the operating lever can be latched to the blocking lever. The operating lever can then be pivoted further in order to overcome the blocking position, as a result of which the blocking section is disengaged from the operating lever, and the blocking lever is moved away from the operating lever. The operating lever is therefore released again, and can be moved by spring force to its rest position, in which the clamping spring is then closed in order to clamp an electrical conductor.

DESCRIPTION OF THE DRAWINGS

The invention will be explained in more detail in the following text with reference to exemplary embodiments and the attached drawings, in which.

DETAILED DESCRIPTION

Figure 1:
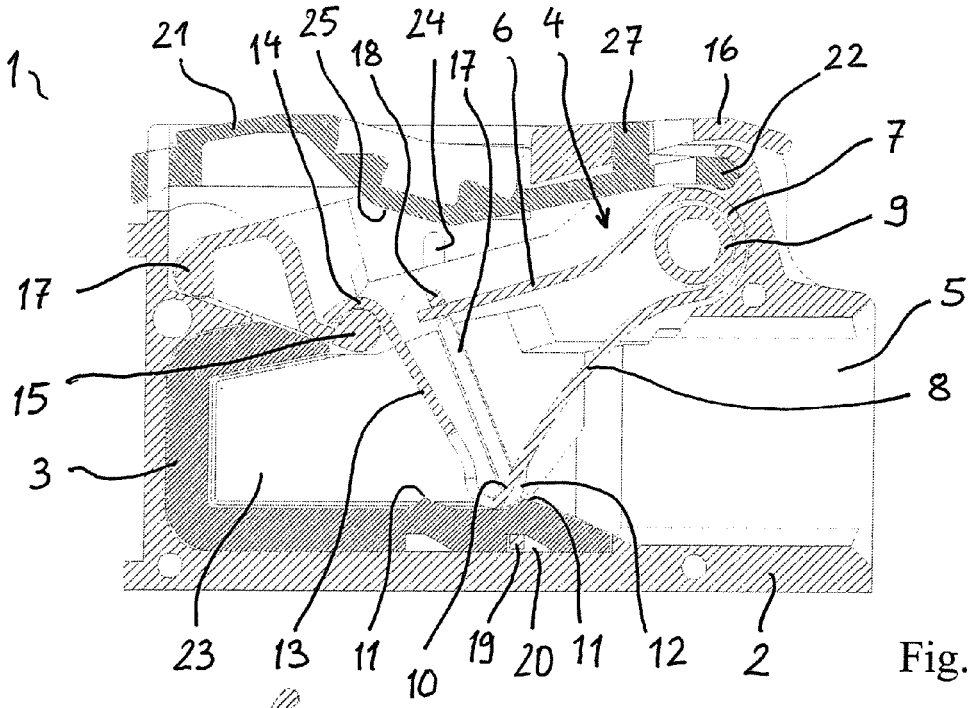
FIG. 1 shows a side section view of a first embodiment of a connecting terminal in the closed clamping position.

FIG. 1 shows a side section view with an insulating-material housing 2. A busbar section 3 and a clamping spring 4 are introduced into the insulating-material housing 2. Furthermore, the insulating-material housing 2 has a conductor insertion opening 5, which is provided for insertion of an electrical conductor.

The clamping spring 4 has a contact section 6, a curved spring area 7 adjacent to it, and a clamping section 8 which is adjacent to the curved spring area. In this case, the clamping spring 4 is mounted with the aid of the curved spring area 7 on a bearing bolt 9 of the insulating-material housing 2. The curved spring area 7 in this case partially surrounds the bearing bolt 9.

At least one free end 10 of the clamping section 8 projects in the direction of the busbar 3, in order to form a clamping point for an electrical conductor which is inserted into the conductor insertion opening 5 and is pushed by the free end 10 against the clamping area 11 of the busbar 3. For this purpose, bulges 12 are provided in the clamping area 11 on the busbar, and face in the direction of the free end 10 of the clamping spring 4 and of the opposite contact limb 6.

The busbar 3 is angled to have a U-shaped cross section in order in this way to provide a holding pocket for an electrical conductor which is inserted into the conductor insertion opening 5 and is passed through under the free end 10 of the clamping spring 4.

An operating section 13 is bent out from the clamping section 8 from the clamping spring 4 and extends from the clamping section 8 in the direction of a plane which is covered by the contact section 6. The free end 14 of the operating section 13 is bent and partially engages over a bearing bolt 15 on an operating lever 16 which can move on a curved path about the pivoting bearing 17. The pivoting bearing 17 of the operating lever 16 is located opposite the conductor insertion opening 5, and above the holding pocket 23 which is formed by the busbar 3.

The operating section 13 is cut out from the spring sheet-metal material of the clamping spring 4 such that the free ends 10 of the clamping section 8 extend further in the direction of the busbar section 3 while, seen over the width of the clamping spring 4, laterally adjacent subareas of the spring sheet-metal material are bent out as the operating section 13.

In this case, by way of example, the free end 10 of the clamping section 8 may form the central area, while the operating section 13 is bent out on the right-hand and left-hand edge areas.

The operating section 13 is preferably not bent with sharp edges, but leaving a curved spring area, in order to ensure elastic articulation of the operating section 13 on the clamping section 8.

The contact section of the clamping spring 4 is fixed with the aid of a bracket 17 relative to the busbar section 3. For this purpose, the contact section 6 passes through an aperture in the bracket 17, and rests on an upper lateral wall 18 of the aperture in the bracket 17.

A further lateral wall 19 is located on the other side of the aperture, opposite the upper lateral wall 18, engages under the busbar section 3 and is preferably hooked into and held in a fixed position in a groove 20 on the lower face of the busbar section 3.

Furthermore, a blocking lever 21 is held constrained by the operating lever 16 in a pivoting bearing 22 on the insulating-material housing 2. The pivoting bearing 22 is located opposite the pivoting bearing 17 of the operating lever 16, and is positioned above the conductor insertion opening 5, adjacent to the curved spring area 7 of the clamping spring 4.

Figure 2:
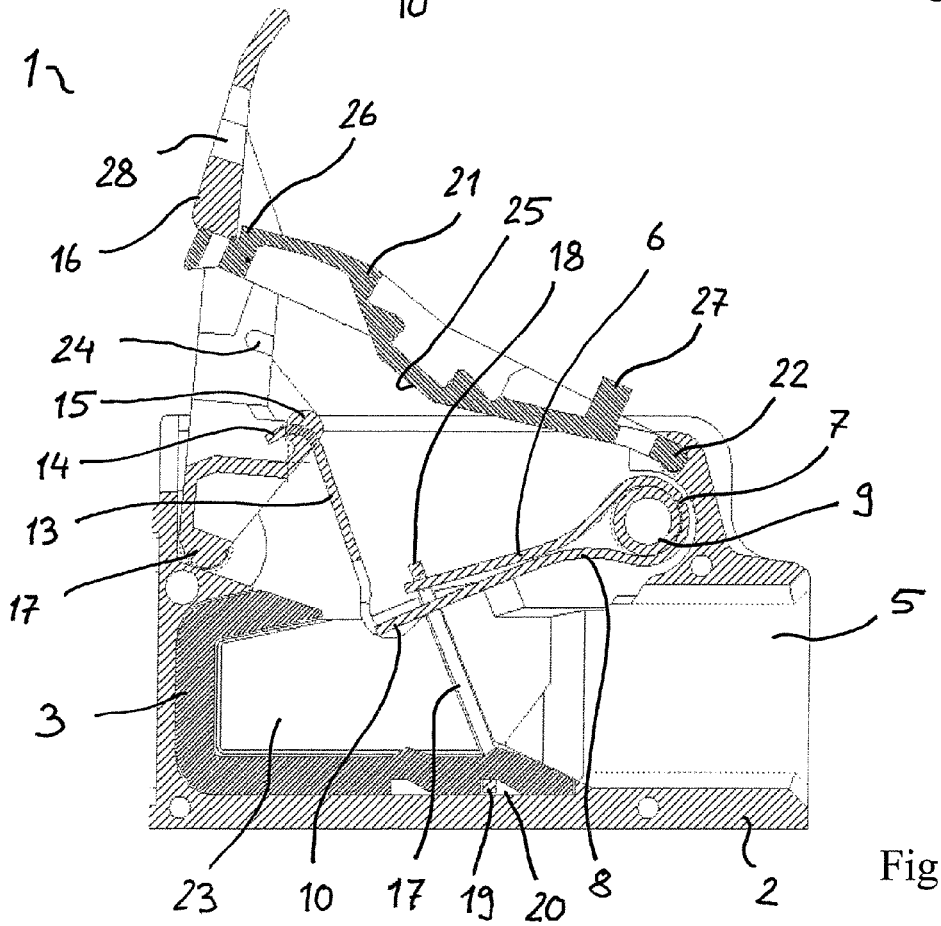
FIG. 2 shows a side section view of the connecting terminal from FIG. 1 in the open position.

When, as is illustrated in FIG. 2, the operating lever 16 is pivoted upward away from the insulating-material housing 2, then the clamping section 8 of the clamping spring 4 is pivoted upward in the direction of the contact limb 6 by a tensile force being exerted on the operating section 13 because the bearing bolt 15 is pivoted upward. In the process, the clamping point for an electrical conductor is opened, and an electrical conductor (not illustrated) can be passed through the conductor insertion opening 5 into the holding pocket 23.

Since the clamping spring 4 exerts an opposing force on the bearing bolt 15 and the operating lever 16, when in the illustrated open position, the operating lever 16 would automatically spring downward, in order to move the clamping spring to the closed position. The blocking lever 21 is provided in order to hold the connecting terminal 1 in the open position. At least one tab 24, which projects at the side, on the operating lever 16 slides along a contour 25 on the lower face of the blocking lever 21, as a result of which the blocking lever 21 is necessarily pivoted at least partially upward when the operating lever 16 is pivoted up. Finally, the blocking lever 21 can be pushed manually further to a blocking position, in which a surface section of the folded-up operating lever 16 abuts against a stop 26 on the blocking lever 21. This prevents the clamping spring 4 from forcing the operating lever 16 to pivot back.

If required, a catch can also be provided, as an alternative to or in addition to the stop 26.

In order to move the connecting terminal 1 back to the closed position, the operating lever 16 is pivoted somewhat further to the left, such that the operating lever 16 is moved away from the stop 26, and no longer engages with the blocking lever 21.

The blocking lever 21 then descends because of the force of gravity and, possibly, as a result of a resetting force, which acts on the pivoting bearing 22 (for example by elastic deformation of the bearing wall abutting on the pin) downward in the direction of the insulating-material housing 2. The operating lever 16 is thus released, and can automatically be moved by the spring force of the clamping spring 4, possibly with manual guidance to its rest position. The clamping point is then closed again, as is illustrated in FIG. 1.

In the rest position, a projecting finger 27 on the blocking lever engages in an opening 28 in the operating lever 16, and thus fixes the operating lever 16 in the rest position.

Figure 3:
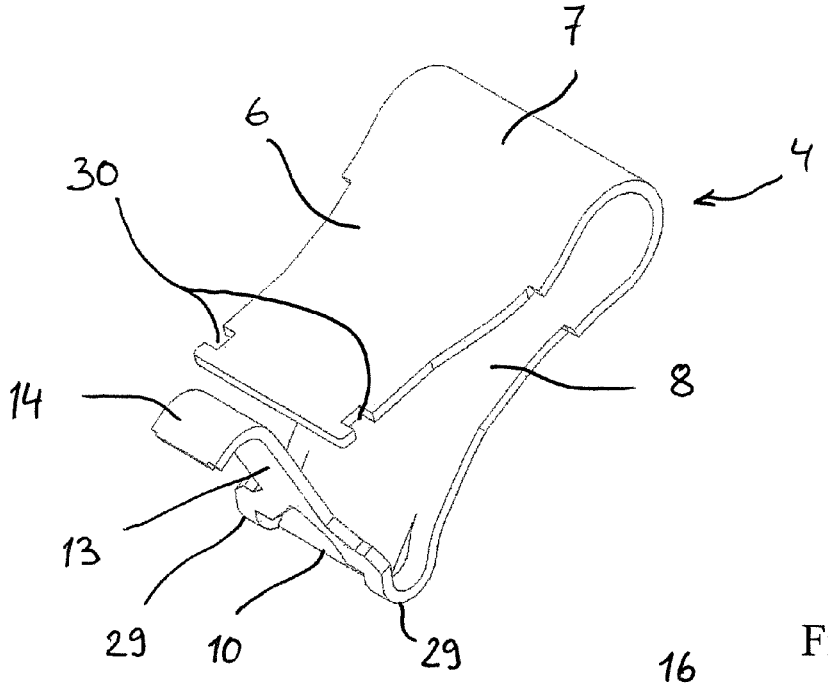
FIG. 3 shows a perspective view of a clamping spring of the connecting terminal from FIGS. 1 and 2.

FIG. 3 shows a perspective view of the clamping spring 4. This clearly shows that the free end 10 is arranged in the central area, seen over the width of the clamping spring 4. The operating section is exposed (cut-out, stamped out, or the like) at the right-hand and left-hand edge areas of the clamping section, leaving the central free end 10 of the clamping section. The edge areas are in this case shaped from the spring sheet-metal material in the form of a curved spring area 29.

Furthermore, the figure clearly shows the bent free end 14 of the operating section 13.

The figure also shows that, adjacent to the front free end, the contact section 6 has mutually opposite side incisions 30, into which side webs of the bracket 17 are hooked.

Figure 4:
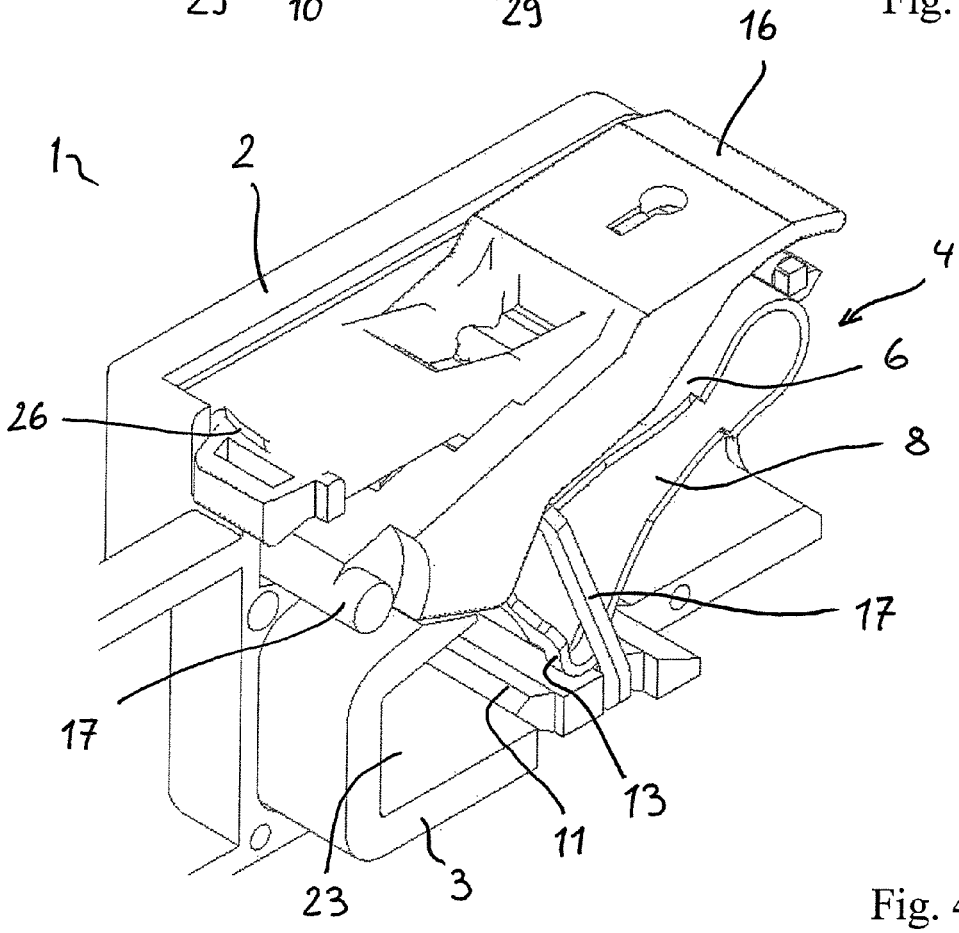
FIG. 4 shows a perspective section view of the connecting terminal from FIGS. 1 and 2.

FIG. 4 shows a perspective partial section view of the connecting terminal 1 from FIGS. 1 and 2. This clearly shows that the operating lever 16 is mounted above the clamping spring 4 such that it can pivot in the insulating-material housing 2, and the blocking lever 21 (shown in FIG. 2) extends in the opposite direction, restricted for this purpose by the operating lever 16.

Figure 5:
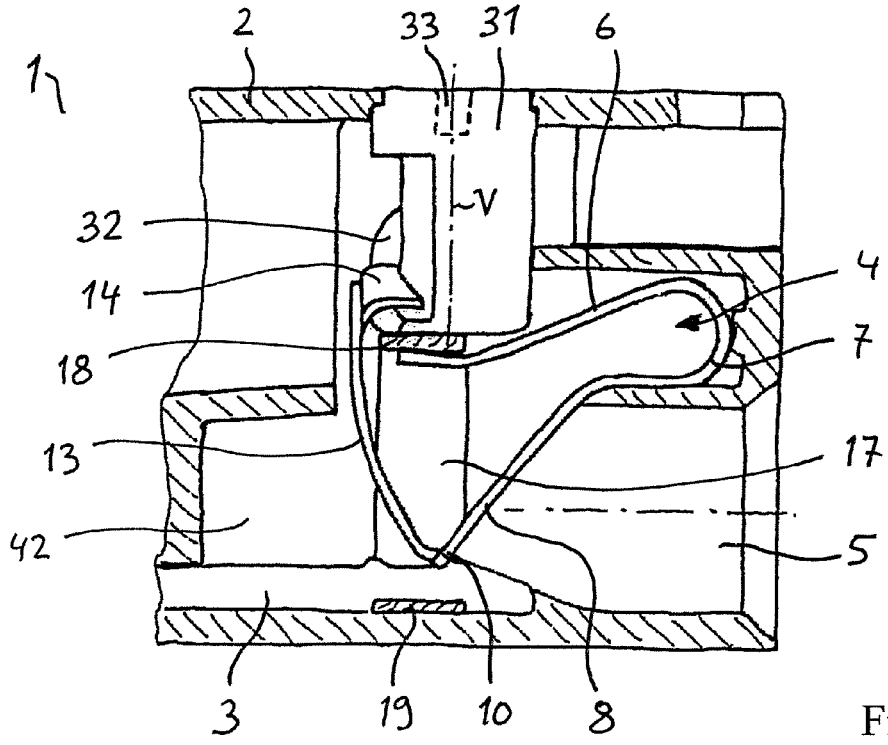
FIG. 5 shows a side section view of a second embodiment of a connecting terminal in the closed clamping position with a vertical operating element which is mounted such that it can rotate.

FIG. 5 shows another embodiment of a connecting terminal 1. In this embodiment as well, the contact limb is mounted on a bracket 17, which engages under the busbar section 3 and is thus mounted on the busbar section 3. The force component of the contact section 6 which acts upward is thus absorbed by the bracket 17, and is transmitted to the busbar section 3. However, the force component of the free end 10 of the clamping spring 4 acts in the opposite direction to this, and, when in the illustrated closed position, is passed directly to the busbar 3. When the electrical conductor is clamped in, the clamping force acts via the electrical conductor on the busbar section 3. This results in a self-supporting system.

In this embodiment, an operating cylinder 31 can clearly be seen, which is aligned in its extended direction vertically, is arranged such that it can rotate about a vertical axis, and is installed in the insulating-material housing 2. The operating cylinder 31 has a support ramp 32, which is inclined obliquely upward and on which the free end 14 of the operating section 13 of the clamping spring 4 rests, which free end 14 is in this embodiment bent differently around in the direction of the conductor insertion opening 5.

A slot 33 for holding a screwdriver is incorporated on the upper face of the operating cylinder 31, by means of which screwdriver the operating cylinder 31 can be rotated about the vertical axis V. The bent free end 14 of the operating section 13 in this case slides upward on the support ramp 32, as a result of which a tensile force is exerted on the operating section 13, and the free end 10 of the clamping section 8 is pivoted upward, in order to open the clamping spring 4. The operating cylinder 31 can optionally be locked in at least one end position, for example by means of a slide (not illustrated), which is held such that it can move linearly in the insulating-material housing 2.

Figure 6:
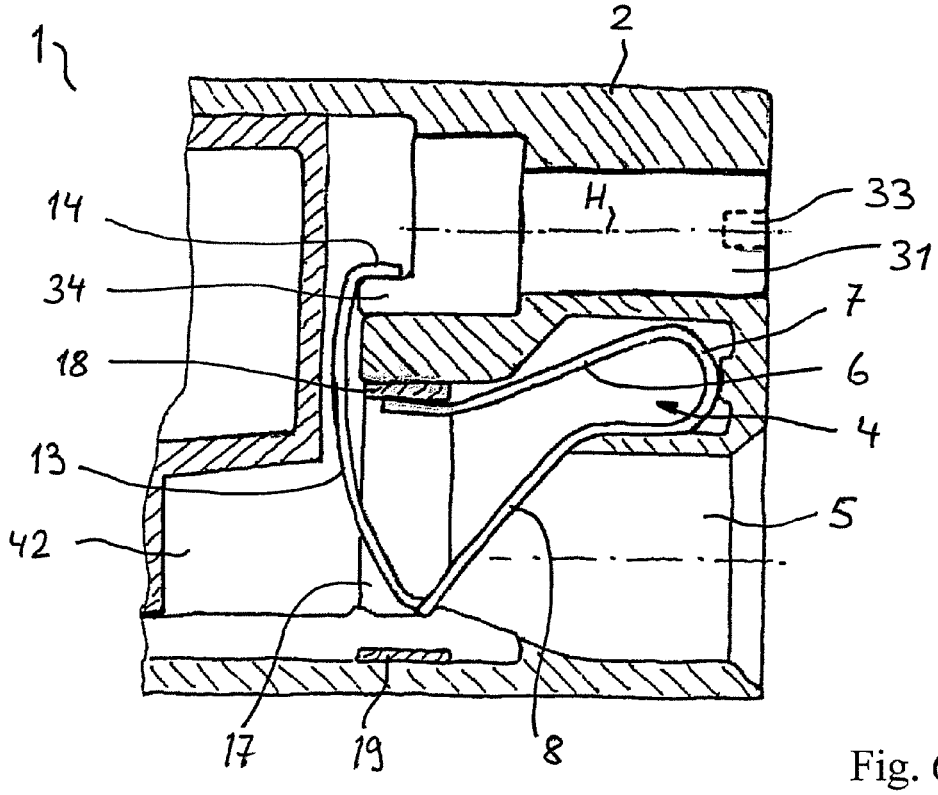
FIG. 6 shows a third embodiment of a connecting terminal in the closed clamping position with a horizontal operating element which is mounted such that it can rotate.

FIG. 6 shows a third embodiment of the connecting terminal 1, in which an operating cylinder 31 is likewise mounted such that it can rotate in the insulating-material housing 2, now about a horizontal axis H. The free end, which is located in the interior of the insulating-material housing 2, of the operating cylinder 31 has a projecting support 34, on which the free end 14, which is bent in the direction of the conductor insertion opening 5, of the operating section 13 of the clamping spring 4 rests. When the operating cylinder 31 is rotated about the horizontal axis H, the above support 34 is moved upward from the illustrated position. In this case, the distance between the support 34 and the busbar section 3 increases, and a tensile force is exerted on the operating section 13, and opens the clamping spring 4.

Figure 7:
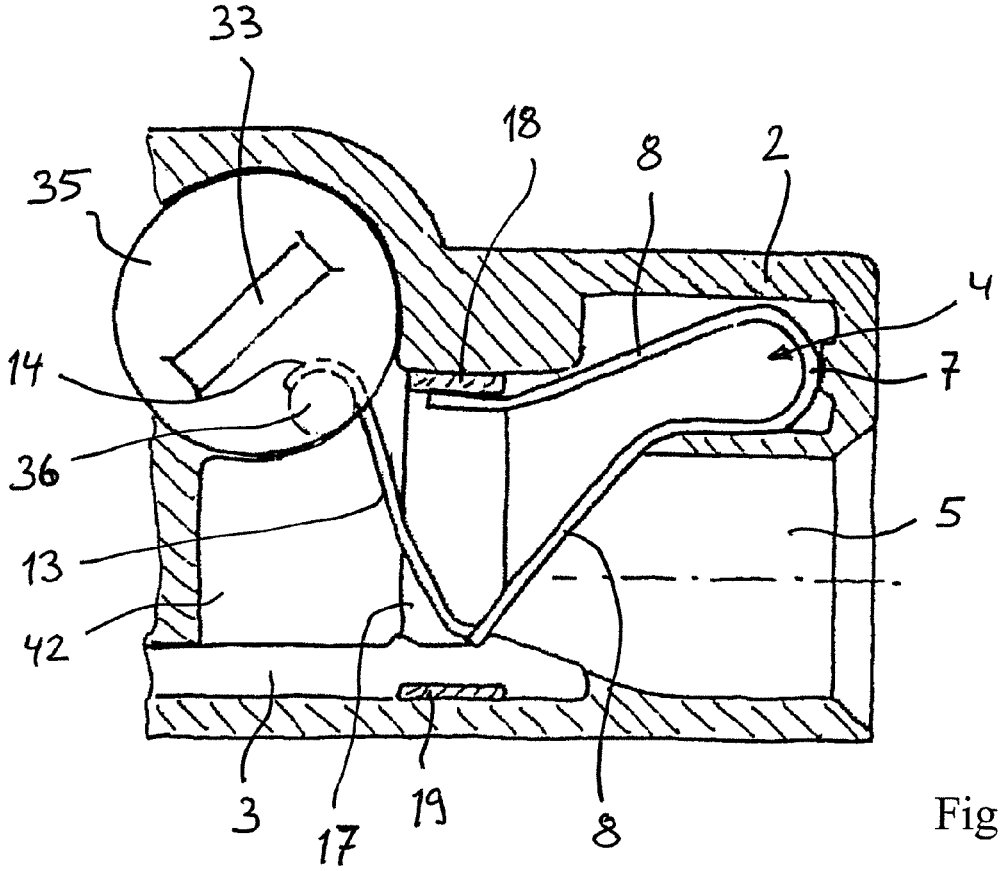
FIG. 7 shows a fourth embodiment of a connecting terminal in the closed clamping position with an operating wheel which is mounted such that it can rotate in the insulating-material housing.

FIG. 7 shows a further embodiment of the connecting terminal 1. In this embodiment, a rotating wheel 35 is mounted above the busbar section 3 such that it can rotate in the insulating-material housing 2, leaving a holding area for an electrical conductor (not illustrated). At least one side free end of the rotating wheel 35, which is externally accessible from the side of the insulating-material housing 2, has an operating slot 33 for insertion, for example, of a screw driver, in order to rotate the rotating wheel 35 in the clockwise direction in order to close the clamping spring 4, and in the counter clockwise direction in order to open the clamping spring. The rotation axis of the rotating wheel 35 is approximately at right angles to the conductor insertion opening 5 and is approximately at right angles to the force exerted by the clamping spring 4, and the direction in which the operating section 13 extends.

In this embodiment, the free end 14, which is bent in the opposite direction to the conductor insertion opening 5, of the operating section 13 is hooked into a bearing bolt 36, and engages partially over this bearing bolt 36. When the operating wheel 35 is rotated in the counter clockwise direction, the bearing bolt 36 is moved upward, as a result of which the distance between the busbar section 3 and the bearing bolt 36 increases. In the process, the free end 14 of the operating section 13 is pulled upward, and a tensile force is exerted on the operating section 13, opening the clamping spring 4.

Figure 8:
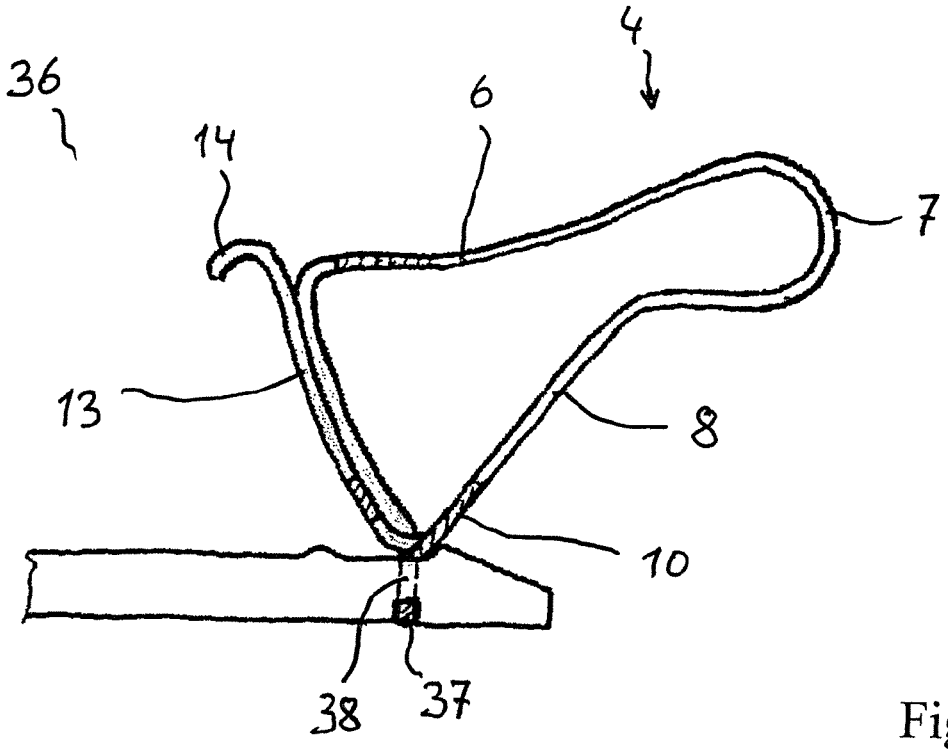
FIG. 8 shows a detail view of a spring clamping unit for a connecting terminal with a tension spring.

FIG. 8 shows a spring clamping unit with a clamping spring 4 in the form of a tension spring, in which the contact section 6 is bent downward in the direction of the busbar section 3 and the free end 10 of the clamping section 8. At its lower end, the contact section 6 has an aperture, which is bounded by a lower edge web 37. The busbar section 3 is passed through the aperture 38. The contact section 6 is fixed with the aid of the lower lateral edge 37 to the free end of the contact section 6 on the busbar section 3.

The operating section 13 is once again bent upward from the clamping section 8, in the opposite direction to the busbar and in the opposite direction to the direction in which the contact section 6, which is bent downward, extends. The free end 14 of the operating section 13 is once again bent, in order to be hooked into an operating element, or for an operating element, for example a screwdriver, to engage under it.

This spring clamping unit 36 can be used in conjunction with various variants of operating elements, for example the operating levers as described above which are arranged such that they can pivot on the insulating-material housing 2, or operating cylinders or operating wheels which are arranged such that they can rotate.

Figure 9:
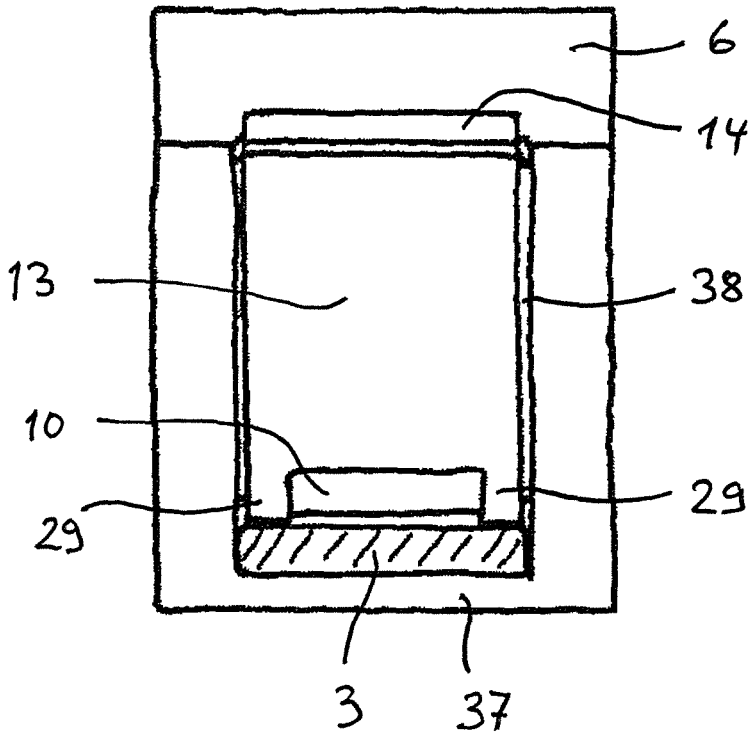
FIG. 9 shows a front view of the spring clamping unit from FIG. 8.

FIG. 9 shows a front view of the spring clamping unit from FIG. 8. The figure clearly shows that the busbar section 3 is passed through an aperture 38 in the contact limb 6.

Figure 10:
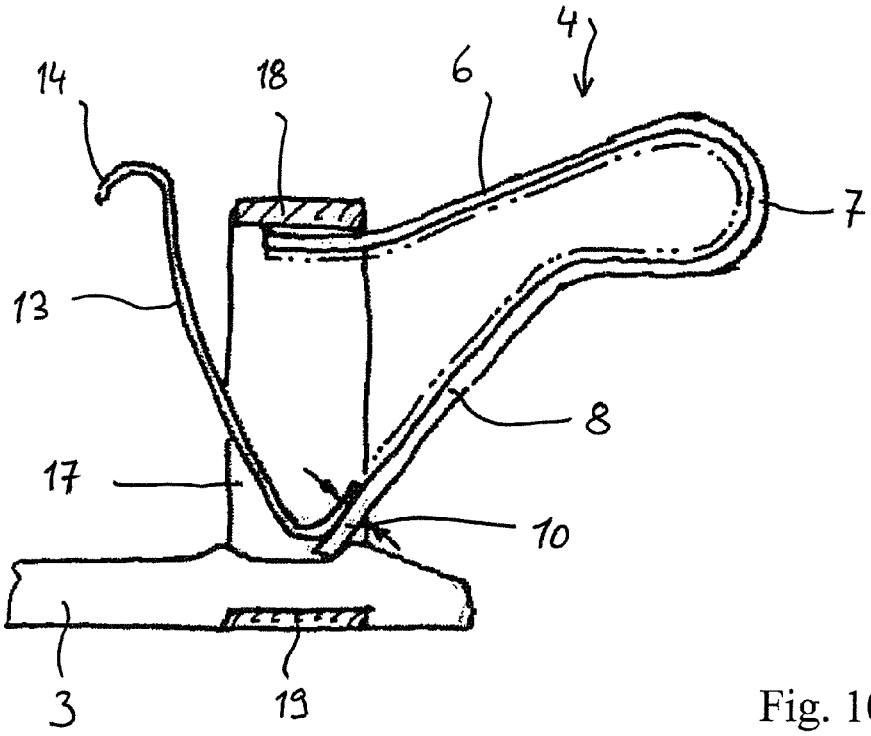
FIG. 10 shows a detail view of one embodiment of a spring clamping unit, in the form of a side section view with a bracket which is mounted on the busbar section.

FIG. 10 shows another embodiment of a spring clamping unit, in which the contact limb 6 is once again hooked by means of a bracket 17 onto the busbar section 3. In this embodiment, the operating section 13 is manufactured as a separate part from the clamping section 8 above the free end 10, and is connected to the clamping section 8 by, for example, riveting, welding or the like. This embodiment advantageously results in a clamping edge being available with the complete width of the clamping section 8 at the free end 10, and in the capability for the operating section 13 to be independent of the characteristics of the clamping spring 4, in particular the material characteristics.

Figure 11:
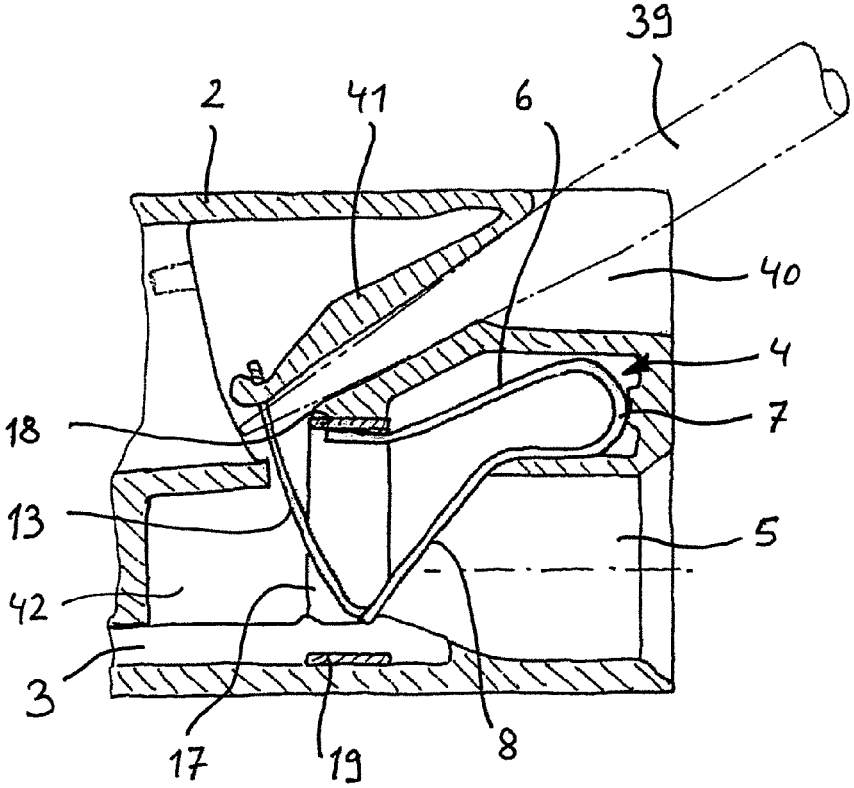
FIG. 11 shows a side section view of a fifth embodiment of a connecting terminal with a screwdriver for operating the spring clamping unit.

FIG. 11 shows an embodiment of a connecting terminal 1 in which the clamping spring 4 is operated by an operating tool 39, for example a screwdriver, which is inserted into an operating opening 39. In this case, the lower face of the operating tool 39 rests on the insulating-material housing 2 in the operating opening 40. The upper face of the operating opening 40 is formed by a wall 41 which can pivot and is formed integrally with the insulating-material housing 2, and from the same insulating material. The wall 41 which can pivot is hooked into the free end of the operating section 13. This results in the operating tool 39 resting on the wall 41 which can pivot, possibly passing through the operating section 13 of the clamping spring 4. A tensile force is exerted on the operating section 13, and the clamping spring 4 is opened, by pivoting the operating tool 39 downward about the fulcrum which is formed on the lower face of the operating channel 40.

In all of the described embodiments, plug contacts, such as plug tongues or the like in the form of forks, can be integrally attached, for example in the conductor insertion direction, to the side of the busbar section 3 facing away from the conductor insertion opening 5. By way of example, these plug contacts may be manufactured as separate parts and may be electrically conductively connected to the busbar section 3 by means of a welded, tox or soldered joint. However, it is also feasible to provide solder feet for a printed circuit board attachment, vertically or horizontally with respect to the conductor insertion direction, on the busbar section 3.

It may be advantageous to form the insulating-material housing 2 from two parts, and for the two halves to be formed symmetrically with respect to one another. The spring clamping unit can then be inserted into one part of the insulating-material housing 2, and can be closed by the second housing half after assembly of the housing.

Figure 12:
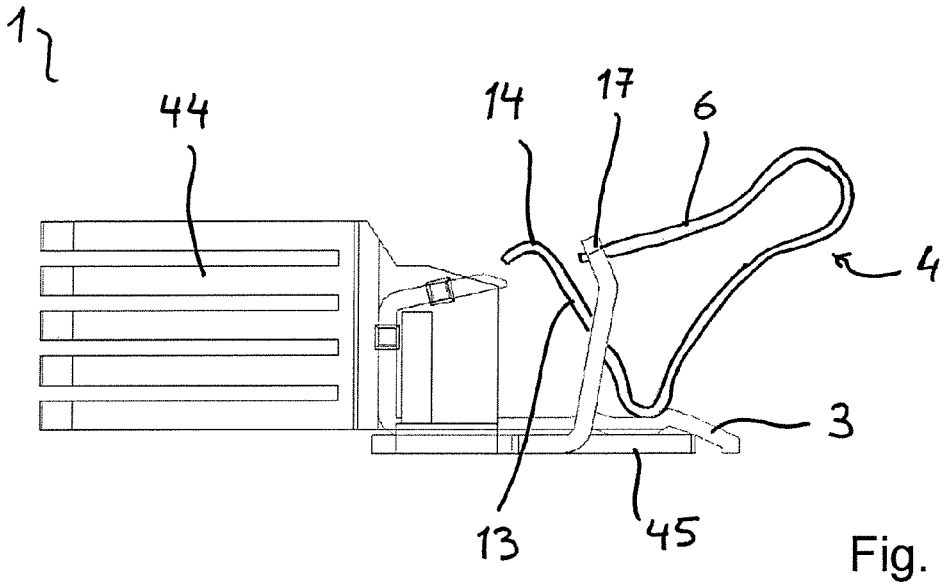
FIG. 12 shows a side view of a sixth embodiment of a connecting terminal having a front plug which is formed integrally with a busbar piece.

FIG. 12 shows a side view of a sixth embodiment of a connecting terminal 1, in which a plug contact in the form of a plug tongue 44, which is in the form of a fork and extends forward, is formed integrally with a busbar piece 45. The bracket 17 is likewise formed integrally with the busbar piece 45 and, for example, is stamped or cut out of it, and is bent out of a contact plane of the busbar piece 45 for the busbar section 3. However, the busbar piece 45 may optionally also be the busbar section 3 itself, as a result of which the plug tongue 44 and the bracket 17 are formed integrally from the busbar section 3.

Figure 13:
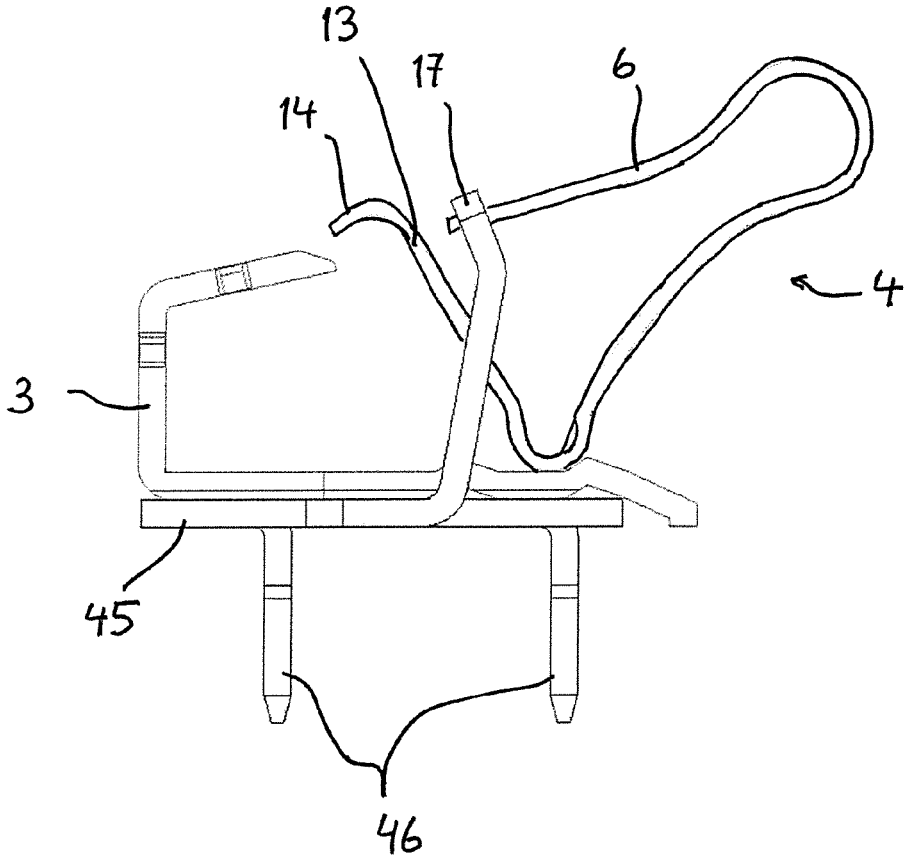
FIG. 13 shows a side view of a seventh embodiment of a connecting terminal having solder pins which project from the busbar section.

FIG. 13 shows a side view of a seventh embodiment of a connecting terminal 1 with solder pins 46 which project downward from the busbar section 3 or from a separate busbar piece 45 adjacent thereto. In this way, the connecting terminal 1 can be inserted into and soldered to a printed circuit board. In this case as well, the bracket 17 is once again formed integrally with the busbar section 3 or, possibly, a busbar piece 45 adjacent thereto, and is bent upward to the contact limb 6 of the clamping spring 4 out of the contact plane, after being cut or stamped out.

The invention claimed is:

1. Connecting terminal, comprising:

an insulating-material housing; and at least one spring clamping unit with a clamping spring and a busbar section in the insulating-material housing, wherein the clamping spring has a contact section and a clamping section configured to clamp an electrical conductor against the busbar section, and the clamping spring has an operating section which originates from the clamping section, extends away from a direction of a spring force which acts on the clamping section of the clamping spring, and is aligned to be acted on by an operating element such that the operating element is engaged with the operating section in order to exert a tensile force, which acts on the operating section in an opposite direction to the spring force when the operating element is moved in order to open the clamping spring.

2. The connecting terminal according to claim 1, wherein the operating element is mounted such that it can move on or in the insulating-material housing.

3. The connecting terminal according to claim 2, wherein the operating element is an operating lever which is mounted such that it can pivot in or on the insulating-material housing, and further comprising one of an operating slide is mounted such that it can move linearly on the insulating-material housing, or an operating wheel, or an operating cylinder mounted such that it can rotate in the insulating-material housing.

4. The connecting terminal according to claim 1, wherein the operating section of the clamping spring has a bent end which is hooked into the operating element.

5. The connecting terminal according to claim 1, wherein the clamping section has at least one free end for clamping an electrical conductor onto the busbar section, and wherein the operating section is formed integrally with the clamping section and is bent away from the clamping section before the at least one free end such that a part of the width of the clamping section forms the at least one free end, and another part of the width of the clamping section forms the operating section.

6. The connecting terminal according to claim 1, wherein the contact section is bent such that it faces the clamping section, and wherein the clamping spring has an aperture through which either the clamping section or the operating section is passed.

7. The connecting terminal according to claim 1, further comprising a bracket arranged on the busbar section, wherein the contact section rests on the bracket and the bracket engages under the busbar section such that the connecting terminal is self-supporting, and a holding force which is exerted by the contact section on the bracket is compensated for via the bracket and a clamping force which is in the opposite direction and acts from the clamping section on the busbar section.

8. The connecting terminal according to claim 1, wherein the busbar section is bent in the direction of the contact section in an area which is adjacent to the clamping section of the clamping spring, and has an aperture for a part of the contact section and a part of the clamping section to pass through, wherein the contact section rests on the busbar section on a boundary edge of the aperture.

9. The connecting terminal according to claim 1, wherein the busbar section is angled in a U-shape to form a holding pocket for the electrical conductor, wherein said holding pocket is arranged opposite a conductor insertion opening for an electrical conductor in the insulating-material housing.

10. The connecting terminal according to claim 1, further comprising a blocking lever which pivots on the upper face of the insulating-material housing and has a blocking section which interacts with the operating lever to hold the operating lever in an open position.

* * * * *